US006203589B1

(12) United States Patent
Ohmori et al.

(10) Patent No.: US 6,203,589 B1
(45) Date of Patent: Mar. 20, 2001

(54) METAL-RESIS BOND GRINDSTONE AND METHOD FOR MANUFACTURING THE SAME

(75) Inventors: Hitoshi Ohmori, Wako; Nobuhide Itoh, Hitachi; Toshio Kasai, Urawa; Toshiro Karaki-Doy, Tokorozawa; Kenichiro Horio, Urawa; Toshiaki Uno, Oyama; Masayuki Ishii, Tokyo, all of (JP)

(73) Assignee: Riken, Wako (JP)

( * ) Notice: Subject to any disclaimer, the term of this patent is extended or adjusted under 35 U.S.C. 154(b) by 0 days.

(21) Appl. No.: 09/415,496

(22) Filed: Oct. 12, 1999

(30) Foreign Application Priority Data

Mar. 31, 1999 (JP) ..... 11-090383

(51) Int. Cl.[7] ..... B24D 3/34; B24D 3/00

(52) U.S. Cl. ..... 51/298; 51/304; 51/293; 51/307

(58) Field of Search ..... 51/295, 298, 304, 51/293, 307

(56) References Cited

U.S. PATENT DOCUMENTS

| | | | | |
|---|---|---|---|---|
| 3,779,727 | * | 12/1973 | Sigui et al. | 51/298 |
| 3,868,232 | * | 2/1975 | Sioui et al. | 51/298 |
| 3,868,233 | * | 2/1975 | Carver et al. | 51/298 |
| 4,042,347 | * | 8/1977 | Sioui | 51/298 |
| 5,611,827 | * | 3/1997 | Hammarstrom et al. | 51/298 |

* cited by examiner

*Primary Examiner*—Michael Marcheschi
(74) *Attorney, Agent, or Firm*—Griffin & Szipl, P.C.

(57) ABSTRACT

The method disclosed here comprises the steps of (a) mixing metal powder, a resin, abrasive grains, and a solid reducing agent at the normal (room) temperature through the melting point of the reducing agent to form a mixture and (b) molding and baking the mixture at the melting point of the reducing agent through that of the metal powder. The solid reducing agent is a fatty acid, preferably stearic acid having a volume ratio of 5 to 20% with respect to the metal powder. With is, it is possible to make metal-resin bond grindstones that give such high-quality mirror surfaces that have conductivity fit for ELID grinding and are not liable to have chippings or scratches and also have an Rmax value of approximately 3 nm or less.

14 Claims, 2 Drawing Sheets

METAL-RESIS BOND GRINDSTONE AND METHOD FOR MANUFACTURING THE SAME

BACKGROUND OF THE INVENTION

1. Field of the Invention

The present invention relates to a metal-resin bond grindstone for use in ELID grinding, and a method for manufacturing the same.

2. Description of the Related Art

Japanese Patent Application Laid-Open No. 1-188266 by the same applicant as in the present application discloses a method and an apparatus for carrying out electrolytic dressing on a conductive grindstone, i.e., dressing in an electrolytic manner a metal bond grindstone, to which a voltage is applied, such as a cast iron fiber bond diamond grindstone or a similar conductive grindstone. The publication reports a success in performing specular grinding on electronic semiconductor materials such as silicon. Besides, the present applicant has developed and announced an apparatus and a method called the Electrolytic In-process Dressing method (hereinafter referred to as the ELID method)(RIKEN Symposium "The Latest Technological Trend of Specular Grinding" held on Mar. 3rd, 1991).

The ELID method uses an apparatus which comprises a grindstone having a contact surface with a work-piece, electrodes facing the grindstone with a distance therebetween, nozzles for allowing a conductive liquid to flow between the grindstone and the electrodes, and a voltage application device (comprising a power supply and a feeder circuit) for applying a voltage between the grindstone and the electrodes, and the voltage is applied between the grindstone and the electrodes while the conductive liquid is allowed to flow between the grindstone and the electrodes, thereby performing the electrolytic dressing on the grindstone.

Since the ELID method can use fine abrasive grains without loading by virtue of the electrolytic dressing, it can thus give an extremely good worked surface such as a mirror surface by the use of the finer abrasive grains. The ELID method can therefore maintain an excellent cutting function of the grindstone ranging from high-performance grinding through mirror finish grinding, and thus the application of the ELID method to various fields of the grinding can be expected.

The above-mentioned ELID method, however, uses an inelastic hard metal as a grindstone bond, so that there are problems of "chipping" of a work-piece during the grinding and "scratches" of the work-piece by the chips. Accordingly, even by the above-mentioned ELID grinding, an obtained mirror surface merely has a Rmax of about 18 to 20, and it has a problem that the higher quality mirror surface cannot be obtained.

Therefore, to obtain the higher quality mirror surface, the conventional methods must use another method such as polishing together, but in such a case, there are problems, such as that the high-performance grinding effect of the ELID grinding is reduced and much time is taken to complete the whole processing.

To solve the above problems, the present inventors have earlier contrived a method and an apparatus in which abrasive grains are mixed with a bonding material comprising metal powder and a resin; the mixture is heated and melted to form a conductive grindstone; and the thus formed conductive grindstone is used to carry out ELID grinding (see Japanese Patent Application Laid-Open No. 7-285071). By this method and the related apparatus, it has been made possible to obtain a high-quality mirror surface with an Rmax value of about 13–15 nm which is not liable to have chippings or scratches.

The above-mentioned conductive grindstone (hereinafter referred to as the metal-resin bond grindstone) which mixes a grindstone and a bonding material comprising metal powder and a resin, gives higher quality of mirror surfaces as the grain diameter of the metal powder is smaller. If, however, the grain diameter of the metal powder is reduced to about 1 $\mu$m, the thus made metal-resin bond grindstone has higher electric resistivity and so loses a conductivity essential for ELID grinding, thus making the grinding impossible. With this problem, the ELID methods using the conventional grindstones cannot obtain high quality mirror surfaces with an Rmax value of 10 nm or less.

SUMMARY OF THE INVENTION

The present invention has been worked out to solve the above-mentioned problems. That is, the object of the present invention is to provide a metal-resin bond grindstone and a method for manufacturing the same that has conductivity fit for the ELID grinding and includes fine metal powder with an average grain diameter of approximately 1 $\mu$m.

The present invention provides a conductive metal-resin bond grindstone characterized in that it comprises metal powder, a resin, and abrasive grains as well as a solid reducing agent which reduces the above-mentioned metal powder.

The present invention also (a) mixes metal powder, a resin, abrasive grains, and a solid reducing agent at a temperature between the normal (room) temperature and the melting point of the reducing agent, both inclusive, to form a mixture and then (b) molds and bakes the mixture at a temperature between the above-mentioned melting point of the reducing agent and the melting point of the metal powder.

According to the above-mentioned grindstone and the manufacturing method of the present invention, by virtue of a solid reducing agent included to reduce metal powder, the mixture can be molded and baked at a temperature of the melting point of the reducing agent through that of the metal powder, to reduce the metal powder during the molding and baking process, thus giving conductivity to the finished grindstone.

According to a preferred embodiment of the present invention, the above-mentioned solid reducing agent is a fatty acid. Also, the above-mentioned fatty acid is preferably stearic acid having a volume ratio of 5 to 20% with respect to the metal powder.

The fatty acid, as can be seen from its chemical formula, has an active carboxyl group containing oxygen atoms in its molecule, and so when it is heated at its melting point or higher and liquefied, an oxide layer having a low conductivity on the surface of the metal powder can be dissolved and removed, and as a result, a high conductivity can be obtained between the particles of the metal powder.

This effect that the fatty acid dissolves and removes the oxide layer on the surfaces of the fine metal powder particles to expose the surfaces of the metal will be called reduction in this specification. Also, the experiments proved that by using especially stearic acid having a volume ratio of 5 to 20% with respect to the metal powder, is possible to give conductivity (low electric resistivity) fit for ELID grinding and to obtain high quality mirror surfaces with an Rmax value of about 3 nm or less.

The other objects and the advantages of the present invention will be clear from the following description with reference to the appended drawings.

DESCRIPTION OF PREFERRED EMBODIMENTS

The following will describe the preferred embodiments of the present invention with reference to the drawings.

Figure 1:
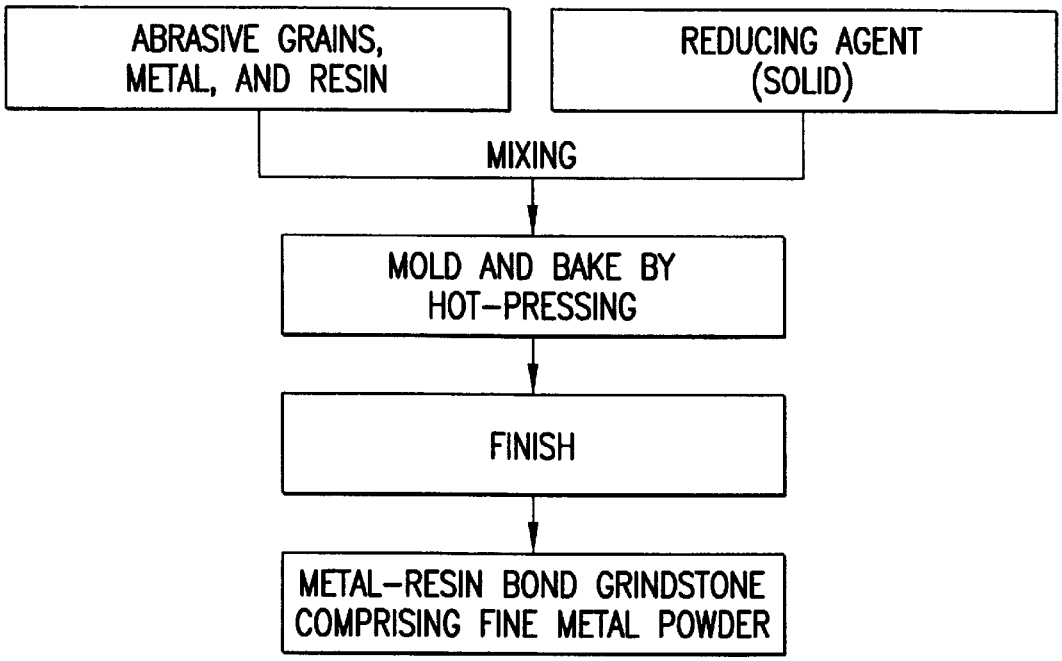
FIG. 1 is a flowchart for a process of manufacturing a metal-resin bond grindstone by the present invention.

FIG. 1 is a flowchart showing a process of manufacturing a metal-resin bond grindstone by the present invention.

As mentioned above, it is necessary for a grindstone usable in the ELID grinding to have conductivity added to itself. If fine metal powder is used, however, the metal powder surface is liable to be oxidized, and this oxide layer has a low conductivity, so that the conductivity of the grindstone may be lost during its molding. According to the method by the present invention, at step (a), metal powder (metal), a resin, abrasive grains, and a solid reducing agent are mixed at the normal (room) temperature through the melting point of the reducing agent to form a mixture and, at step (b), the mixture is molded and baked at the melting point of the reducing agent through that of the metal powder.

That is, the method by the present invention molds and bakes a grindstone as reducing the metal powder during the molding of the grindstone, thus assuring conductivity. This manufacturing method specifically adds appropriate amounts of abrasive grains, a bond material comprising metal powder and a resin, and a reducing agent (solid) which reduces the metal powder, and mixes these and then molds and bakes the grindstone by hot-pressing etc. The reducing agent which can be employed can be liquefied as the baking temperature rises and can reduce the metal, i.e., can dissolve and remove the oxide film on the surfaces of the metal powder particles.

The reducing agent that can be used in the methods by the present invention must satisfy the following conditions: (a) to be a solid at the molding temperature; (b) to be liquefied at a temperature during grindstone molding (e.g., 200° C. or lower) to reduce metal, i.e., to dissolve and remove the oxide film on the surfaces of the metal powder particles; (c) to have such a weak acid as to dissolve and remove the oxide layer alone on the metal surface; and (d) to be easy to handle. As the reducing agents that satisfy these conditions, the inventors of the present invention paid attention to the following fatty acids which contain an oxygen atoms in the acidic carboxyl group in the molecule. The chemical formulae and the melting points of these fatty acids are listed in Table 1 below.

TABLE 1

| Name | Chemical formula | Melting point |
|---|---|---|
| Acetic acid | $C_4H_8O_2$ | −7.9°C. |
| Caporic acid | $C_6H_{12}O_2$ | −3.4°C. |
| Caprylic acid | $C_6H_{16}O_2$ | 16.7°C. |
| Lauric acid | $C_{10}H_{20}O_2$ | 31.6°C. |

TABLE 1-continued

| Name | Chemical formula | Melting point |
|---|---|---|
| Milstin acid | $C_{12}H_{24}O_2$ | 44.2°C. |
| Palmiric acid | $C_{14}H_{28}O_2$ | 54.4°C. |
| Stearic acid | $C_{16}H_{32}O_2$ | 62.9°C. |
| Arachidic acid | $C_{20}H_{40}O_2$ | 75.3°C. |
| Behemic acid | $C_{22}H_{44}O_2$ | 79.9°C. |

According to the method by the present invention, a mixture of metal powder, a resin, abrasive grains, and a solid reducing agent mixed at for example the normal (room) temperature is molded and baked at the melting point of the reducing agent through that of the metal powder. By heating this mixture at the melting point of the reducing agent or higher, the reducing agent can be liquefied to reduce, i.e., dissolve and remove the oxide on the metal surface in order to give conductivity. Note here that if this temperature exceeds the melting point of the metal powder, the metal powder may be molten and fluidized as a whole so that the abrasive grains may be unevenly distributed.

As can be seen from Table 1, among the fatty acids, an acetic acid with the smallest molecular weight has the lowest melting point of −7.9° C., followed by the others in an order of increasing molecular weights and the accompanying higher melting points. As fatty acids used in the present experiments are preferable such ones as having melting points of 40° C. or higher considering the environmental temperature of the normal temperature through 30° C. in a work place for manufacturing grindstones, among which stearic acid with the melting point of 69.6° C. is especially preferable. If copper powder is used as the metal powder, copper oxide constituting the oxide layer on its surface and stearic acid react in accordance with the following chemical formula 1 to dissolve and remove the film of copper oxide:

$$CuO+2C_{18}H_{36}O_6 \rightarrow Cu(C_{18}H_{35}O_2)+H_2O \quad \text{(Formula 1)}$$

EXAMPLE

A metal-resin bond grindstone was made according to the above-mentioned method and tested for its characteristics. The test comprised the steps of (1) verification of a reducing agent, (2) manufacturing of the grindstone according to the process shown in FIG. 1, and (3) ELID grinding of thus made grindstone, in this order. As the fine metal powder, spherical copper powder with a diameter of 1 μm was used and as the abrasive grains, diamond abrasive grains with an average diameter of about 5 nm (#3000000).

The following will describe the results.

1. Effects of Reducing Agent and Influences by Formulation Percentage

To make sure of the effects of a reducing agent, basic checks were conducted on the influences by the formulation percentage between metal (spherical copper powder having diameter of 1 μm) and the reducing agent (stearic acid) on the electric conductivity. In the experiments, only metal powder and stearic acid were used and mixed at a volumetric percentage of 0%, 5%, 10%, 15%, 20%, and 30% and molded at pressures of 49 Mpa and 78.4 Mpa and baked at 200° C. to make testing strips in order to check the electric resistivity.

Figure 2:
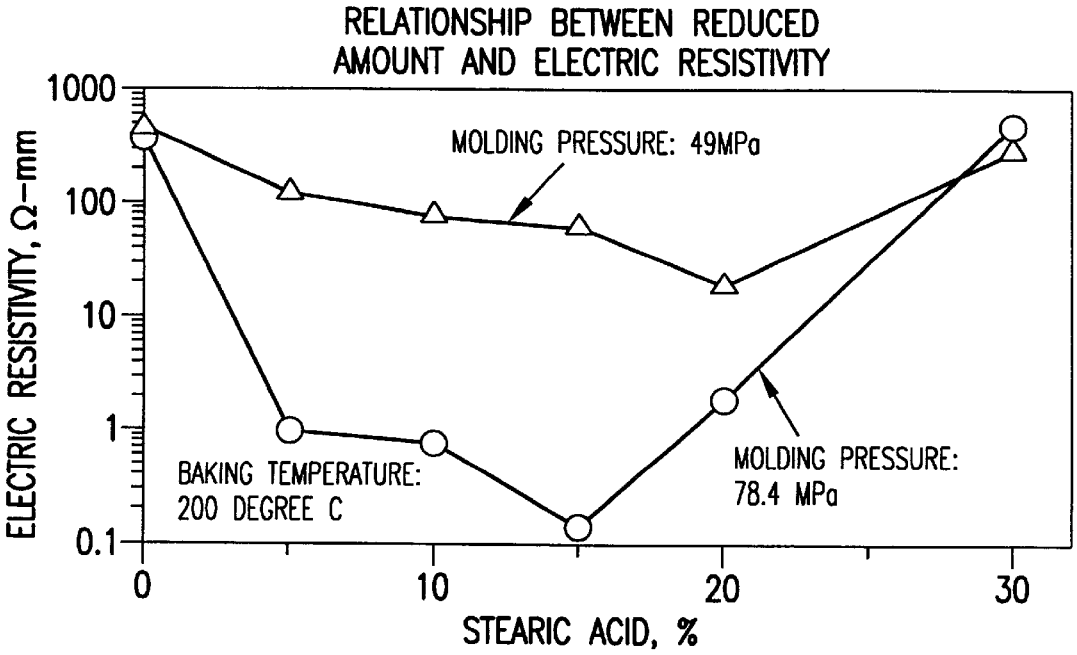
FIG. 2 is a graph showing a relationship between the reduced amount and the electric resistivity in experiments by the present invention.

FIG. 2 shows a graph for the relationship between the reduced amount and the electric resistivity. As shown in it, a testing strip with 0%-stearic acid metal powder exhibited an electric resistivity as high as 1000 Ω-mm. On the contrary, when 5% to 20% of stearic acid was added, the electric resistivity lowered drastically, with the lowest resistivity of 0.23 Ω-mm at the 15%-stearic acid case. When, however, stearic acid was added by 30% or more, the electric resistivity exhibited a tendency to rise. This is considered because the amount of excessive stearic acid not involved in the reduction contributed to the rise in the resistivity. As for the molding pressure on the other hand, the higher the pressure (78.4 MPa), the lower was the resistance overall. This is considered because the contact ratio among metal powder itself was increased with the higher molding pressure.

2. Grindstone Molding Experiment

Taking the above-mentioned results into stearic acid with respect to metal powder at 5 to 20% and changed the formulation percentage among the metal powder, a resin, and the stearic acid and discussed the results. The results of electric resistivity at each formulation percentage are shown in Table 2. As shown in it, the No. 1 conditions came up with the smallest resistivity, where the formulation percentage was 78.3:8.7:13.0 of the metal, the resin, and the stearic acid. In this case, the grindstone thus made was in a good state without cracks or chippings.

TABLE 2

| No. | Metal % | Resin % | Stearic acid % | Ratio of stearic acid to metal | Resistivity Ω-mm |
|---|---|---|---|---|---|
| 1 | 78.3 | 8.7 | 13.0 | 16.6 | 0.4 |
| 2 | 81.8 | 9.1 | 9.1 | 11.1 | 0.8 |
| 3 | 85.7 | 9.5 | 4.8 | 5.6 | 2.2 |
| 4 | 69.6 | 17.4 | 13.0 | 18.7 | 2.0 |
| 5 | 72.7 | 18.2 | 9.1 | 12.5 | 0.6 |
| 6 | 76.2 | 19.0 | 4.8 | 6.2 | 3.3 |

As shown in the table above, the Nos. 1–6 grindstones exhibited low resistivity of 0.6 to 3.3 Ω-mm, giving such conductivity fit for ELID grinding. These grindstones had metal powder percentages of approximately 70–85% and resin percentages, approximately 9 to 20%. The percentage of the stearic acid with respect to the metal powder was approximately 5 to 20%. With this, it was confirmed that conductivity fit for ELID grinding can be given within these ranges.

3. Working

Figure 3:
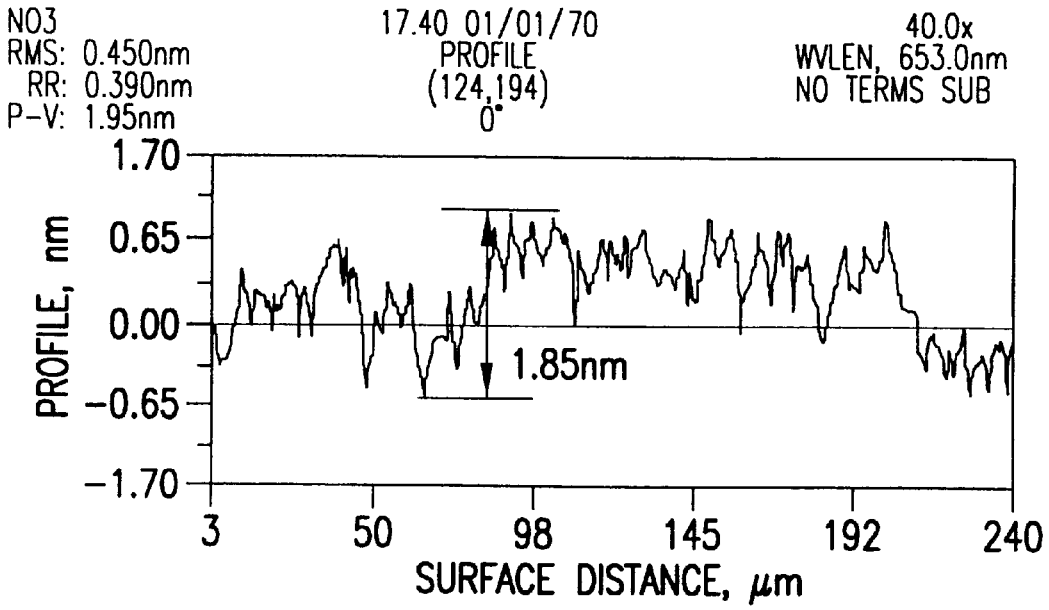
FIG. 3 is a graph showing surface roughness of an ELID ground surface by a metal-resin bond grindstone by the present invention.

Under the No. 1 conditions, the inventor made a metal-resin bond grindstone (concentration degree: 75) with dimensions of 250 (diameter)×20 (width) (#3000000) and conducted ELID lapping working on mono-crystalline silicon. The experiments came up with a result of a high quality worked surface of 1.85 nmPV of mono-crystalline silicon. FIG. 3 shows an example of the profile of the worked surface roughness.

As mentioned above, it was confirmed that lapping of grindstones by use of a metal-resin bond grindstone and the ELID method by the present invention can create high-quality worked surfaces that cannot by given by the conventional grinding technologies. Especially by using a metal-resin bond grindstone comprising ultra-fine diamond abrasive grains, it has been made possible to achieve finished surfaces comparable to those by the conventional lapping or polishing methods, as good as 2–3 nmRy of worked surface roughness of the hard-brittle materials.

As can be seen from the above description, the metal-resin bond grindstone and the method for manufacturing the same by the present invention have excellent effects in that, for example, it is possible to obtain such high-quality mirror surfaces that have conductivity fit for ELID grinding and are not liable to have chippings or scratches and also have an Rmax value of approximately 3 nm or less, by comprising fine metal powder with an average of 1 μm or so.

Although the present invention has been described by use of a few preferred embodiments, it will be understood that the rights of the present invention are not limited to those embodiments. Instead, those rights include all the alterations, the modifications, and the equivalent written in the appended claims.

What is claimed is:

1. A metal-resin bond conductive grindstones, comprising: metal powder, a resin, abrasive grains, and a solid reducing agent which reduces said metal powder.

2. A method for manufacturing a metal-resin bond grindstone, comprising the steps of:

(a) mixing metal powder, a resin, abrasive grains, and a solid reducing agent at a temperature between about room temperature and a melting point of said reducing agent to form a mixture; and (b) molding and baking said mixture at a temperature between the melting point of said reducing agent and a melting point of said metal powder.

3. The method of manufacturing a metal-resin bond grindstone according to claim 2, wherein said solid reducing agent is a fatty acid.

4. The method of manufacturing a metal-resin bond grindstone according to claim 3, wherein said fatty acid is stearic acid used in a volume ratio of 5 to 20% with respect to the amount of the metal powder.

5. The method of manufacturing a metal-resin bond grindstone according to claim 2, wherein said molding and baking temperature is 200° C.

6. A metal-resin bond conductive grindstone according to claim 1, wherein said solid reducing agent is a fatty acid.

7. A metal-resin bond conductive grindstone according to claim 6, wherein said fatty acid is stearic acid.

8. A metal-resin bond conductive grindstone according to claim 1, wherein said solid reducing agent is present in an amount of between 5 and 20% by volume with respect to the metal powder.

9. A metal-resin bond conductive grindstone according to claim 6, wherein said fatty acid is present in an amount of between 5 and 20% by volume with respect to the metal powder.

10. A metal-resin bond conductive grindstone according to claim 6, wherein said grindstone has a resistivity of 0.6 to 3.3 ohm-mm.

11. A metal-resin bond conductive grindstone according to claim 7, wherein said grindstone has a resistivity of 0.6 to 3.3 ohm-mm.

12. A metal-resin bond conductive grindstone according to claim 8, wherein said grindstone has a resistivity of 0.6 to 3.3 ohm-mm.

13. A metal-resin bond conductive grindstone according to claim 9, wherein said grindstone has a resistivity of 0.6 to 3.3 ohm-mm.

14. A metal-resin bond conductive grindstone, comprising: metal powder, a resin, abrasive grains, and a solid reducing agent which reduces said metal powder, wherein said grindstone has a resistivity of 0.6 to 3.3 ohm-mm.

* * * * *

UNITED STATES PATENT AND TRADEMARK OFFICE

CERTIFICATE OF CORRECTION

PATENT NO. : 6,203,589 B1
DATED : March 20, 2001
INVENTOR(S) : Hitoshi Ohmori et al.

It is certified that error appears in the above-identified patent and that said Letters Patent is hereby corrected as shown below:

Title page,
at "[54]", please correct the title to read:
--METAL-RESING BOND GRINDSTONE AND METHOD FOR MANUFACTURING THE SAME--.

Title page,
at "(75)" , please correct the identification of the inventors to read:
--Hitoshi Ohmori, Wako; Nobuhide Itoh, Hitachi; Toshio Kasai, Urawa; Toshiroh Karaki-Doy, Tokorozawa; Kenichiro Horio, Urawa; Toshiaki Iino, Oyama; Masayuki Ishii, Tokyo, all of (JP) --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,203,589 B1
DATED : March 20, 2001
INVENTOR(S) : Hitoshi Ohmori et al.

It is certified that error appears in the above-identified patent and that said Letters Patent is hereby corrected as shown below:

Title page,
Item [54], please correct the title to read:
--METAL-RESIN BOND GRINDSTONE AND METHOD FOR MANUFACTURING THE SAME --.

Item [75], please correct the identification of the inventors to read:
-- Hitoshi Ohmori, Wako; Nobuhide Itoh, Hitachi; Toshio Kasai, Urawa; Toshiroh Karaki-Doy, Tokorozawa: Kenichiro Horio, Urawa; Toshiaki Iino; Oyama; Masayuki Ishii, Tokyo, all of [JP] --.

This certificate supercedes certificate of correction issued August 14, 2001.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*